United States Patent [19]

Kayes

[11] Patent Number: 4,974,687

[45] Date of Patent: Dec. 4, 1990

[54] SOIL DISPLACEMENT HAMMER

[76] Inventor: Allan G. Kayes, Elwin, Boyce's Hill, Newington, United Kingdom

[21] Appl. No.: 327,766

[22] Filed: Mar. 23, 1989

[30] Foreign Application Priority Data

Mar. 28, 1988 [GB] United Kingdom ..... 8807359

[51] Int. Cl.[5] ..... E21B 4/14; E21B 7/08

[52] U.S. Cl. ..... 175/19; 175/73

[58] Field of Search ..... 175/19, 73, 74, 92, 175/296, 61, 62; 173/91, 44, 45, 40, 132

[56] References Cited

U.S. PATENT DOCUMENTS

| | | | |
|---|---|---|---|
| 3,630,295 | 12/1971 | Coyne et al. | 175/73 |
| 3,677,354 | 7/1972 | Kostylev et al. | 175/61 X |
| 3,712,391 | 1/1973 | Coyne | 175/61 X |
| 3,794,128 | 2/1974 | Gagen et al. | 175/19 |
| 3,797,586 | 3/1974 | Coyne et al. | 175/19 X |
| 3,952,813 | 4/1976 | Chepurnoi et al. | 173/91 |
| 4,095,655 | 6/1978 | Still | 175/19 |
| 4,144,941 | 3/1979 | Ritter | 175/61 X |
| 4,396,073 | 8/1983 | Reichman et al. | 175/74 |
| 4,621,698 | 11/1986 | Pittard et al. | 175/19 X |
| 4,632,191 | 12/1986 | McDonald et al. | 175/19 |
| 4,648,746 | 3/1987 | Abinett | 175/19 X |
| 4,694,913 | 9/1987 | McDonald et al. | 175/61 |
| 4,809,789 | 3/1989 | MacFarlane | 173/91 |

FOREIGN PATENT DOCUMENTS

| | | | |
|---|---|---|---|
| 323433 | 11/1988 | European Pat. Off. . | |
| 2364846 | 7/1974 | Fed. Rep. of Germany . | |
| 3406364 | 11/1984 | Fed. Rep. of Germany . | |
| 3423465 | 2/1985 | Fed. Rep. of Germany . | |
| 8703924 | 7/1987 | PCT Int'l Appl. . | |
| 485200 | 1/1976 | U.S.S.R. | 175/19 |
| 994646 | 2/1983 | U.S.S.R. | 173/91 |
| 2121453 | 12/1983 | United Kingdom . | |
| 2134152 | 8/1984 | United Kingdom . | |
| 2147035 | 5/1985 | United Kingdom . | |

*Primary Examiner*—Hoang C. Dang

*Attorney, Agent, or Firm*—Darby & Darby

[57] ABSTRACT

The invention provides a steerable soil displacement hammer for driving holes in the ground. This comprises a substantially cylindrical body (1) and a soil displacement head (2) at a forward end of the body. The head is of larger diameter than the body so as to tend to create an enlarged hole around the body when the head is driven through the ground. At the rear end of the body a pivotable member is provided for directing said rear end away from the center of this hole.

2 Claims, 2 Drawing Sheets

SOIL DISPLACEMENT HAMMER

This invention relates to a soil displacement hammer. More particularly, the invention relates to a steerable soil displacement hammer for driving holes in the ground.

Soil displacement hammers, commonly referred to as "moles", can be used to install pipes, cables or conduits in the ground without the necessity for excavating a continuous trench. Soil displacement hammers of this kind are described, for example, in GB-A-2 134 152 and GB-A-2 147 035.

WO 87/03924 describes a steerable soil displacement hammer. This is characterised by a retractable baffle member mounted adjacent the forward end of the body. When the baffle member projects transversely from one side of the body, the soil displacement hammer is caused to describe a curved path in the ground.

An object of the present invention is to provide a soil displacement hammer with improved steering means.

The present invention thus provides a soil displacement hammer for driving holes in the ground, comprising a substantially cylindrical body, a soil displacement head at a forward end of the body, a longitudinally reciprocable striking member housed within the body, and an anvil member within the body adjacent its forward end and adapted to receive hammer blows from the striking member to cause the body to be driven forward, characterised in that the head is of larger diameter than the body so as to tend to create an enlarged hole around the body when the head is driven through the ground, and means are provided at the rear end of the body for directing said rear end away from the centre, i.e. towards the side, of the enlarged hole.

In one embodiment a thrust-providing member is arranged off-centre at the rear end of the body. When a machine of this kind is to be driven in a straight line through the ground, the steering means at the rear end in effect cause the rear end to describe a circular path around the periphery of the enlarged hole. When the machine is to be steered, the rear end is directed only toward one side of the enlarged hole. This results in the machine turning in the direction away from the side to which the rear end has been steered.

Reference is now made to the accompanying drawings, in which.

Figure 1:
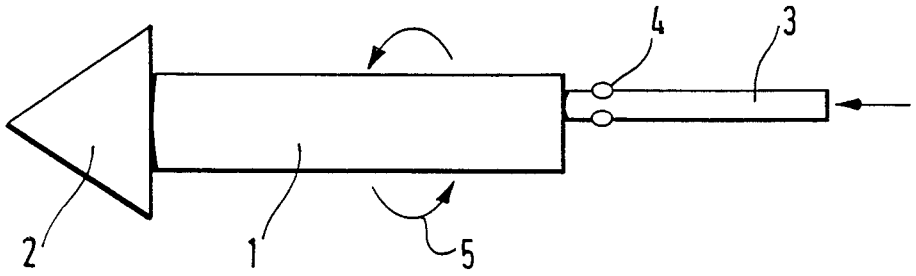
FIG. 1 is a diagrammatic representation of a first embodiment according to the invention.

With reference to FIG. 1, the machine is a pneumatically operated soil displacement hammer operating in conventional manner from an external air supply via a flexible hose. The construction of such a machine is well known to those in the art and therefore does not need to be further described here. The machine comprises a cylindrical body 1 and a soil displacement head 2 at a forward end of the body. The head 2 is of larger diameter than the body 1 so that, as the machine is driven through the ground, an enlarged hole is created around the body. Linked to the rear end of the body is a solid tube 3. The tube 3 has a universal joint 4 near the rear end of the body, and is attached off-centre to the rear end. The machine is driven through the ground in conventional manner by pneumatic thrust, but in addition extra thrust is applied to the machine via the tube 3. In view of the off-centre mounting of the tube, the rear end of the machine is directed away from the centre of the hole. This will tend to result in the machine turning in the direction away from the side to which the rear has been steered. The machine is driven in a straight line by causing the entire machine, including the tube 3, to rotate about the central longitudinal axis as shown by the arrows 5. Such turning is powered by conventional mechanical arrangements. As the machine rotates, the rear end is directed by the tube 3 in a circular path (when viewed from the end) around the periphery of the enlarged hole.

Figure 2:
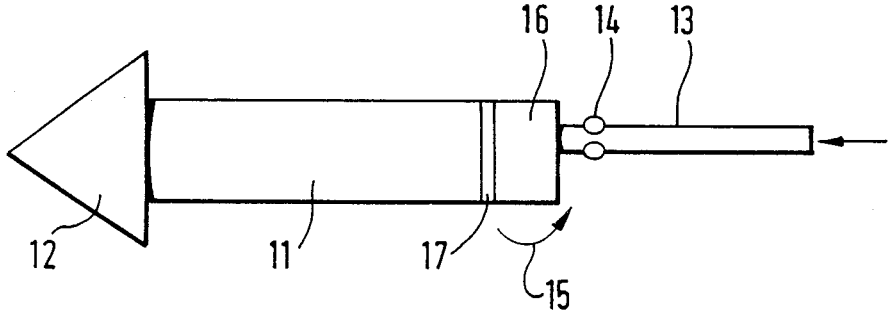
FIG. 2 is a diagrammatic representation of a second embodiment.

The arrangement illustrated in FIG. 2 is somewhat similar to that in FIG. 1. The machine has a cylindrical body 11 and enlarged head 12. A solid tube 13, having a universal joint 14, is mounted off-centre on the rear end. However, in FIG. 2, the machine as a whole does not revolve, but only a section 16 at the rear end, which is connected to the remainder of the machine by bearings 17, which permit the section 16 to rotate as shown by the arrows 15. Again, extra thrust is applied to the machine via the tube 13. Straight line boring and steering are carried out in analogous manner to that described for FIG. 1.

Figure 3:
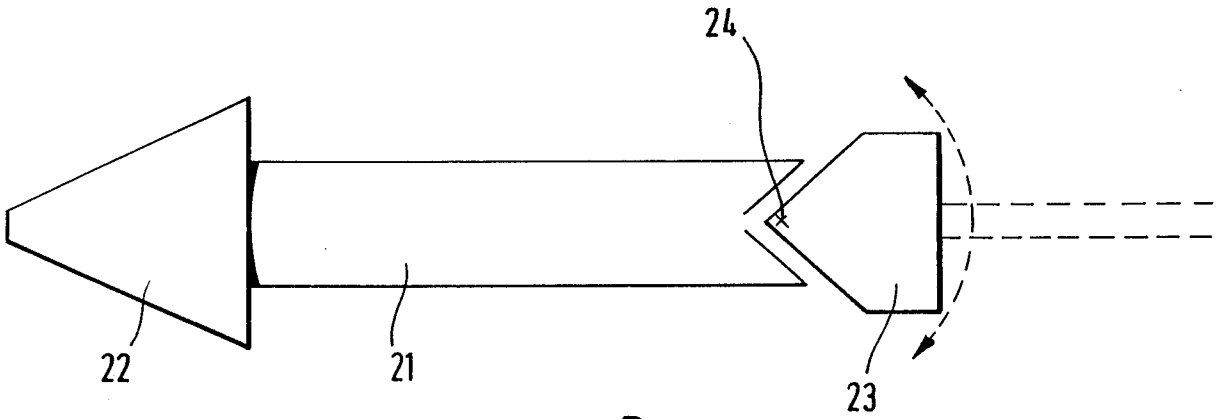
FIG. 3 is a diagrammatic representation of a third embodiment.

The machine shown in FIG. 3 also comprises a cylindrical body 21 and enlarged head 22. It also has a back-end 23 which is enlarged to around the same diameter as the head. The back-end is pivoted about a central point 24 and can move through an arc in any direction across the back of the machine. This movement of the back-end of the machine is achieved by suitable power operated devices and is controlled by the operator of the machine. The machine and back-end do not revolve and no extra thrust is necessary to the back; only the air hose, power supply to the movable rear end and tracking equipment are connected to the machine. When the machine is to be driven in a straight line the swivelling back-end 23 is held in a central position by the powered controls. When the machine is to be steered the operator causes the back-end 23 to move across an arc towards one edge of the mole. This will cause the rear end of the cylindrical part of the machine to move towards the corresponding side of the bored hole. The head of the machine will then turn in a direction away from that edge.

I claim:

1. A soil displacement hammer for driving holes in the ground, comprising a substantially cylindrical body, a soil displacement head at a forward end of the body, a longitudinally reciprocable striking member housed within the body, and an anvil member within the body adjacent its forward end and adapted to receive hammer blows from the striking member to cause the body to be driven forward, wherein the head is of larger diameter than the body so as to tend to create an enlarged hole around the body when the head is driven through the ground, and steering means are provided at a rear end of the body for directing said rear end of said body away from the centre of the hole, said steering means including a member having a forward end and a rear end and being of substantially the same diameter as said head, pivot means connecting said forward end of said member to the rear end of said body, whereby said soil displacement hammer describes a straight path through the ground, said pivot means enabling movement of said member towards a first periphery of the hole to direct the rear end of said body towards the opposite periphery to cause the soil displacement hammer to describe a curved path in a direction towards said first periphery.

2. A soil displacement hammer as recited in claim 1, wherein the body is of substantially uniform cross-section.

* * * * *